US006795670B2

(12) United States Patent
Abreu

(10) Patent No.: US 6,795,670 B2
(45) Date of Patent: Sep. 21, 2004

(54) DISCOROTRON CHARGING DEVICE

(75) Inventor: Christian O. Abreu, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 92 days.

(21) Appl. No.: 10/282,269

(22) Filed: Oct. 28, 2002

(65) Prior Publication Data

US 2004/0081484 A1 Apr. 29, 2004

(51) Int. Cl.[7] ..... G03G 15/02
(52) U.S. Cl. ..... 399/170; 250/324; 399/171
(58) Field of Search ..... 399/170–172; 250/324–326

(56) References Cited

U.S. PATENT DOCUMENTS 5,272,507 A * 12/1993 Yoshida et al. ..... 399/171
5,539,501 A * 7/1996 Yu et al. ..... 250/324
5,581,330 A * 12/1996 Pietrowski et al. ..... 399/171
5,781,829 A * 7/1998 Wong et al. ..... 250/324

* cited by examiner

*Primary Examiner*—William J. Royer
(74) *Attorney, Agent, or Firm*—Lloyd F Bean, II

(57) ABSTRACT

In a high speed color printer wherein color images are produced by superposing a developed image atop another developed image, the improvement including a charging system for charging a surface, including: at least two coronodes; a housing with the at least two coronodes spaced from each other; a grid interposed between the surface and the at least two coronodes; a shield, interposed between the housing and the at least two coronodes; a first power supply for biasing the grid and shield; a second power supply for energizing each of the at least two coronodes; and a phase controller connected to the second power supply and adapted to control energizing of the at least two coronodes such that each of the at least two coronodes is charged at a phase difference.

20 Claims, 3 Drawing Sheets

DISCOROTRON CHARGING DEVICE

CROSS-REFERENCE TO RELATED APPLICATION

Figure 1:
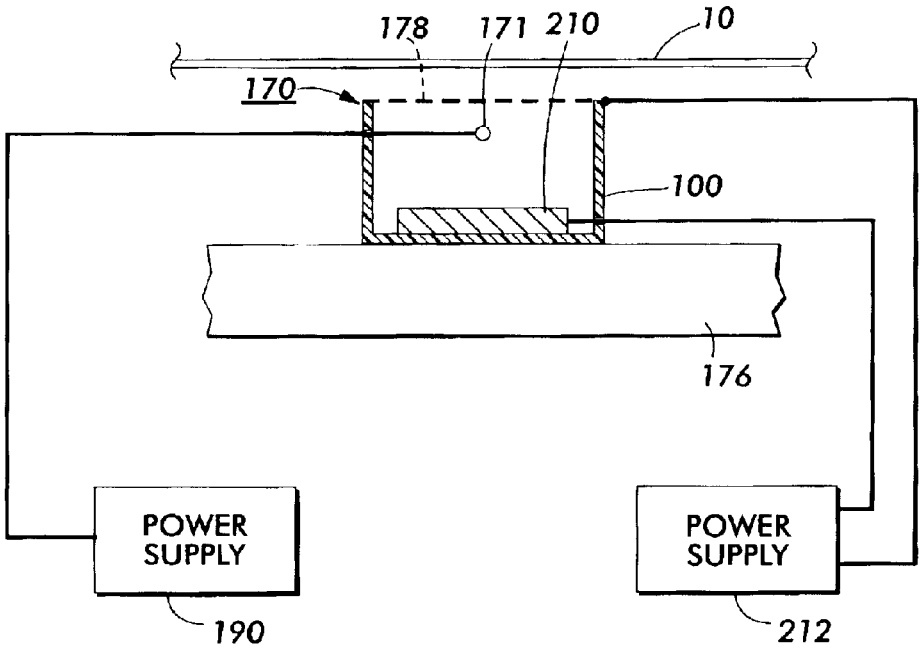

Reference is made to commonly-assigned copending U.S. patent application Ser. No. 10/282,281 filed concurrently herewith, entitled "Discorotron Charging Device," by Christian O. Abreu, the disclosure of which is incorporated herein.

This invention relates generally to a corona generating device, and more particularly concerns a discorotron.

In a typical electrophotographic printing process, a photoconductive member is charged to a substantially uniform potential so as to sensitize the surface thereof. The charged portion of the photoconductive member is exposed to a light image of an original document being reproduced.

Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet.

The toner particles are heated to permanently affix the powder image to the copy sheet.

In printing machines such as those described above, corona devices perform a variety of other functions in the printing process. For example, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions.

One form of a corona charging device comprises a corona electrode in the form of an elongated wire connected by way of an insulated cable to a high voltage AC/DC power supply. The corona wire is partially surrounded by a conductive shield. The photoconductive member is spaced from the corona wire on the side opposite the shield. An AC voltage may be applied to the corona wire and at the same time, a DC bias voltage is applied to the shield to regulate ion flow from the corona wire to the photoconductive member being charged.

Another form of a corona charging device is pin corotrons and scorotrons. The pin corotron comprises an array of pins integrally formed from a sheet metal member that is connected by a high voltage cable to a high power supply. The sheet metal member is supported between insulated end blocks and mounted within a conductive shield. The photoconductive member to be charged is spaced from the sheet metal member on the opposite side of the shield. The scorotron is similar to the pin corotron, but is additionally provided with a screen or control grid disposed between a coronode and the photoconductive member. The screen is held at a lower potential approximating the charge level to be placed on the photoconductive member. The scoroton provides for more uniform charging and prevents over charging.

Still other forms of corona charging devices include a dicoroton. The dicoroton comprises a coronode having a conductive wire that is coated with an electrically insulating material. When AC power is applied to the coronode by way of an insulated cable, substantially no net DC current flows in the wire due to the thickness of the insulating material. Thus, when the conductive shield forming a part of dicorotron and the photoconductive member passing thereunder under at the same potential, no current flows to the photoconductive member or the conductive shield. However, when the shield and photoconductive member are at different potentials, for example, when there is a copy sheet attached to the photoconductive member to which toner images have been electrostatically transferred thereto, an electrostatic field is established between the shield and the photoconductive member which causes current to flow from the shield to ground.

A high speed color machine capable of producing 100 or more images per minute, such as the iGen3™ manufactured by Xerox, requires a charging device capable of delivering uniform charging performance during high speed imaging. Further, there is needed a charging device which is insensitive to toner contamination due to image on image development at high speeds.

There is provided a high speed color printer wherein color images are produced by superposing a developed image atop another developed image, the improvement comprising a charging system for charging a surface, comprising: a coronode, said coronode being a glass coated wire; a housing with said coronode positioned therein; a grid interposed between the surface and said coronode; a shield, interposed between the housing and said coronode; a power supply for biasing said grid and shield; and an AC power supply for energizing said coronode.

Figure 2:
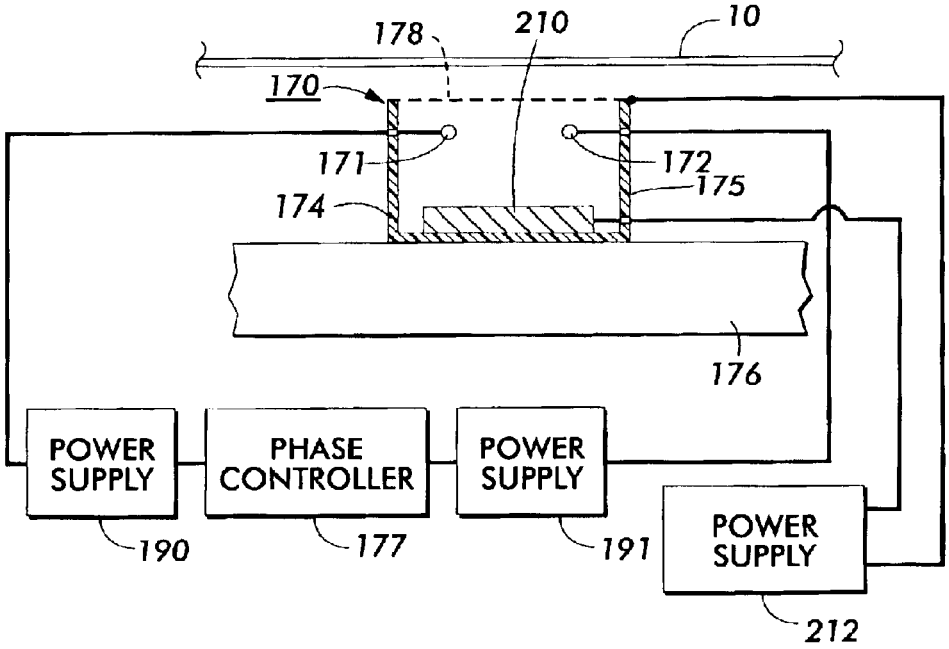
Figure 3:
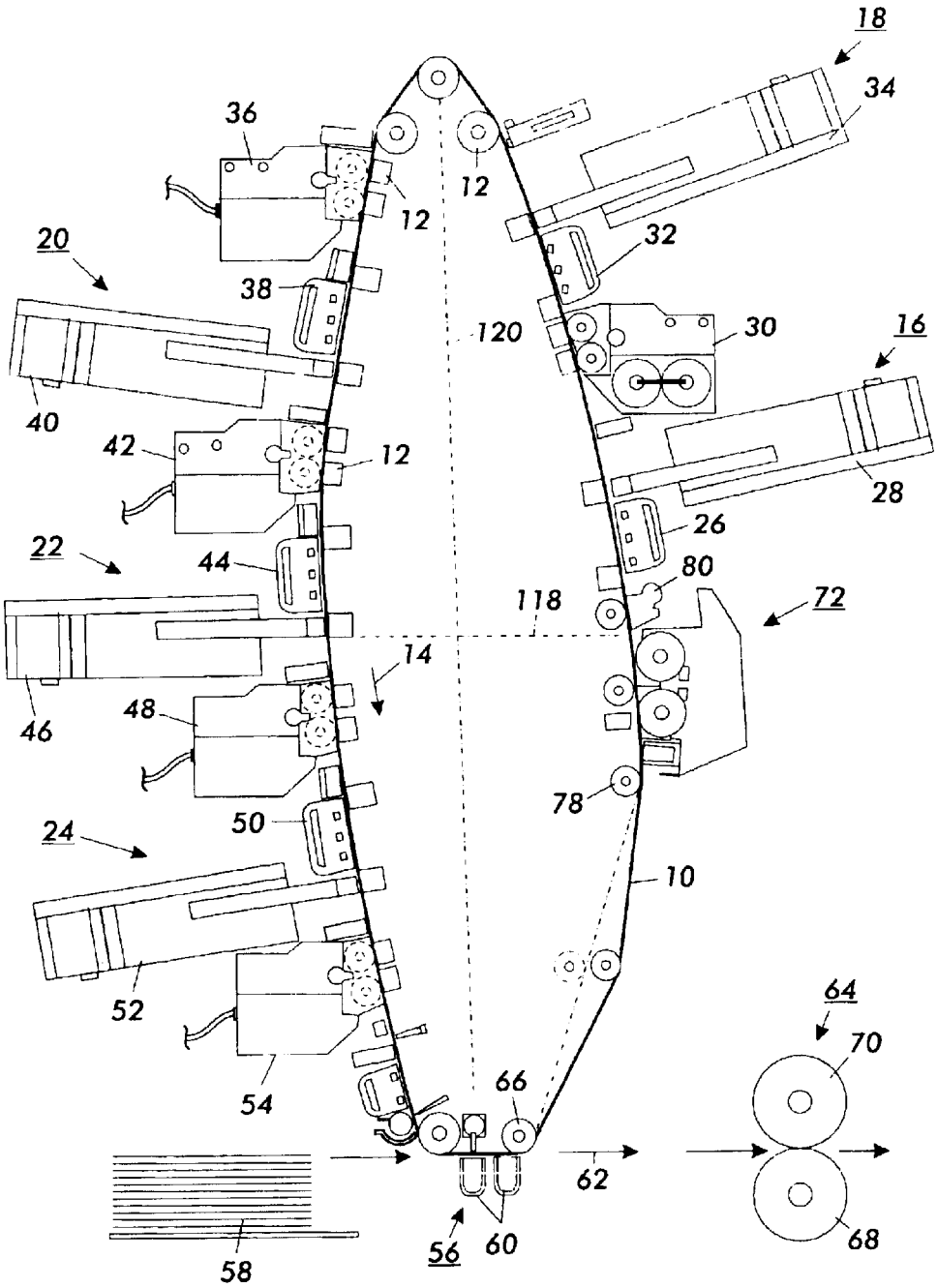

Other aspects of the present invention will become apparent as the following description proceeds and upon reference to the drawings, in which:

FIGS. 1 and 2 are illustrated configurations of discorotrons useful in printer apparatus; and FIG. 3 is a schematic elevational view depicting an illustrative high speed color electrophotographic printing machine incorporating the apparatus of the present invention therein.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring initially to FIG. 3, there is shown a high speed color electrophotographic printing machine, capable of producing over 100 images per minute, such as a Xerox GEN3®, having a charging device of the present invention therein. Referring now to the drawing, there is shown a single pass multi-color printing machine. This printing machine employs a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 120, 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device including a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes a corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes a corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to developer unit 54.

At developer unit 54, black toner particles are deposited on the exterior surface of photoconductive belt 10. These black toner particles form a black toner powder image which may be partially or totally in superimposed registration with the previously formed yellow and magenta toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner pewder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Turning now to FIG. 1 inclusive, there is illustrated configurations of discorotrons useful in the printer apparatus of FIG. 3, charging devices 26, 32, 38, 44 and 50 are identical to discorotron 170.

In FIG. 1, a discorotron 170 is shown supported by member 176 closely adjacent to photoconductive belt 10. Discorotron 170 is used herein to mean a dielectric coated coronode wire with a charge leveling screen and biased shield located at a predetermined distance from the coronode wire. A housing 100 is an insulated housing. A dielectric coated coronode wire 171 with a charge leveling grid 178 located at a predetermined distance from the coronode wire 171. The preferred distance is about 7 mm to 8 mm. The charge leveling grid 178 is positioned about 2 mm to 5 mm from the surface of the photoconductive belt 10 and is powered by power supply 212. Opposed from the charge leveling grid 178 and coronode wire 171 is a shield 210. Charge leveling grid 178 is powered by power supply 212. Shield 210 is positioned on the bottom of housing 100 and is powered by power supply 212. Coronode wire 171 is powered by AC power supply 190.

The preferred coating on the coronode wire 171 is a glass coating. Applicants have found using extensive research efforts that the preferred the wire diameter is about 0.003 to 0.0035 inches and the glass coating is about 0.0035 to 0.0045.

In FIG. 2 is another embodiment of the present invention, a discorotron system 170 is shown supported by frame member 176 closely adjacent to photoconductive belt 10. The discorotron system 170 comprises two coronode wires 171 and 172 that are enclosed in housing that includes opposite sides by walls 174 and 175 and a charge leveling grid 178 that are mounted on a bottom support member positioned on frame member 176. Coronode wires 171 and 172 are spaced between 4 mm and 25 mm.

Charge leveling grid 178 is powered by power supply 212. A shield 210 is positioned on the bottom of housing and is powered by power supply 212. Coronode wires 171 and 172 are powered by AC power supplies 190 and 191, respectively and phase controlled by phase controller 177. Discorotron system 170 is accomplished by setting coronode wires 171 and 172 at a different phase with phase controller 177, preferably 180 degrees apart for charging frequency set at 4 kHz to 10 kHz.

In recapitulation, Applicant has found that the present invention exhibits excellent uniform corona emission, the wires are insensitive to toner contamination, they exhibit a very high IV characteristic slope at the current crossover point and the crossover point is relatively insensitive to grid to photoreceptor spacing over a range of +/−0.25 mm. The IV characteristic slope also can be increased by operating adjacent glass coated wires out of phase to reduce field suppression. This enables higher current generation at the same peak-to-peak voltage.

It is, therefore, apparent that there has been provided in accordance with the present invention, a charging apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claim is:

1. In a high speed color printer wherein color images are produced by superposing a developed image atop another developed image, the improvement comprising a charging system for charging a surface, comprising:

at least two coronodes;

a housing with said at least two coronodes spaced from each other;

a grid interposed between the surface and said at least two coronodes;

a shield, interposed between the housing and said at least two coronodes;

a first power supply for biasing said grid and shield;

a second power supply for energizing each of said at least two coronodes; and a phase controller connected to said second power supply and adapted to control energizing of said at least two coronodes such that each of said at least two coronodes is charged at a phase difference.

2. The charging system according to claim 1, wherein said first power supply biases said grid and shield at substantially different voltages.

3. The charging system according to claim 1, wherein said first power supply biases said grid and shield to substantially the same voltage.

4. The charging system according to claim 1, wherein said phase difference is substantially 180 degrees.

5. The charging system according to claim 1, wherein said at least two coronodes are coated wires, and wherein said coated wires are charged at a frequency of more than 4 kHz.

6. The charging system according to claim 1, wherein spacing between said at least two coronodes is less than 25 mm.

7. The charging system according to claim 1, wherein said at least two coronodes are dielectric, and wherein spacing between said at least two coronodes is at least 4 mm.

8. The charging system according to claim 1, wherein said at least two coronodes are positioned about 7 to 8 mm from said shield.

9. The charging system according to claim 1, wherein said grid is position about 2 mm to 5 mm from the surface.

10. The charging system according to claim 1, wherein said at least two coronodes comprise a wire having a diameter about 0.003 to 0.0035 inches and has a glass coating of about 0.0035 to 0.0045.

11. A charging system for charging a surface, comprising:

at least two coronodes;

a housing with said at least two coronodes spaced from each other;

a grid interposed between the surface and said at least two coronodes;

a shield, interposed between the housing and said at least two coronodes;

a first power supply for biasing said grid and shield;

a second power supply for energizing each of said at least two coronodes; and a phase controller connected to said second power supply and adapted to control energizing of said at least two coronodes such that each of said at least two coronodes is charged at a phase difference.

12. The charging system according to claim 11, wherein said first power supply biases said grid and shield at substantially different voltages.

13. The charging system according to claim 11, wherein said first power supply biases said grid and shield to substantially the same voltage.

14. The charging system according to claim 11, wherein said phase difference is substantially 180 degrees.

15. The charging system according to claim 11, wherein said at least two coronodes are coated wires, and wherein said coated wires are charged at a frequency of more than 4 kHz.

16. The charging system according to claim 11, wherein spacing between said at least two coronodes is less than 25 mm.

17. The charging system according to claim 11, wherein said at least two coronodes are dielectric, and wherein spacing between said at least two coronodes is at least 4 mm.

18. The charging system according to claim 11, wherein said at least two coronodes are positioned about 7 to 8 mm from said shield.

19. The charging system according to claim 11, wherein said grid is position about 2 mm to 5 mm from the surface.

20. The charging system according to claim 11, wherein said at least two coronodes comprise a wire having a diameter about 0.003 to 0.0035 inches and has a glass coating of about 0.0035 to 0.0045.

* * * * *